US008216527B2

(12) United States Patent
Dzuong

(10) Patent No.: US 8,216,527 B2
(45) **Date of Patent: *Jul. 10, 2012**

(54) POSITIVE DISPLACEMENT PUMP WITH PRESSURE SENSOR

(75) Inventor: Jimmy Dzuong, San Jose, CA (US)

(73) Assignee: Tecan Trading AG, Mannedorf (CH)

( * ) Notice: Subject to any disclaimer, the term of this patent is extended or adjusted under 35 U.S.C. 154(b) by 0 days.

This patent is subject to a terminal disclaimer.

(21) Appl. No.: 12/985,119

(22) Filed: Jan. 5, 2011

(65) Prior Publication Data

US 2011/0182782 A1 Jul. 28, 2011

Related U.S. Application Data

(63) Continuation of application No. 12/692,089, filed on Jan. 22, 2010.

(51) Int. Cl.
*B01L 3/00* (2006.01)

(52) U.S. Cl. ..... 422/505; 422/500; 422/501; 422/502; 422/503; 422/504; 222/14; 222/41

(58) Field of Classification Search ..... 422/500–505; 222/14, 41

See application file for complete search history.

(56) References Cited

U.S. PATENT DOCUMENTS

| | | | | |
|---|---|---|---|---|
| 1,403,685 | A | 1/1922 | Hammett | |
| 3,442,443 | A | 5/1969 | Kilbourn | |
| 5,320,810 | A * | 6/1994 | Al-Mahareeq et al. | 422/517 |
| 5,499,545 | A | 3/1996 | Kimura et al. | |
| 5,612,227 | A | 3/1997 | Inoue et al. | |
| 6,015,067 | A * | 1/2000 | Lang et al. | 222/153.13 |
| 7,314,598 | B2 | 1/2008 | Nishino | |
| 2004/0048393 | A1 | 3/2004 | Colin et al. | |
| 2004/0159675 | A1 | 8/2004 | Nishino | |
| 2004/0169052 | A1 | 9/2004 | Wu | |
| 2006/0127281 | A1 * | 6/2006 | Bjornson et al. | 422/100 |
| 2007/0102445 | A1 | 5/2007 | Nay et al. | |

FOREIGN PATENT DOCUMENTS

| | | |
|---|---|---|
| DE | 3531241 | 3/1987 |
| EP | 0215534 | 3/1987 |
| EP | 0283832 | 9/1988 |

(Continued)

*Primary Examiner* — Jyoti Nagpaul

(74) *Attorney, Agent, or Firm* — Notaro, Michalos & Zaccaria P.C.

(57) ABSTRACT

A positive displacement pump (1) is equipped with a pump cylinder (2), a pump piston (7), a cylinder space (9), a pressure sensor (10), and a pressure channel (12). A main portion (13) of the pressure channel (12) extends parallel to a longitudinal axis (3) of the pump cylinder (2), for providing fluidic connection between the cylinder space (9) and the pressure sensor (10). In the improved alternative positive displacement pump (1), the cylinder wall (4) comprises a piston sleeve (14) that is located on the inner side of the cylinder wall (4) and that extends over essentially the entire length of the pump cylinder (2) to the cylinder bottom (5). The improved alternative positive displacement pump (1) is further characterized in that, the main portion (13) of the pressure channel (12) is located in the cylinder wall (4) comprising the piston sleeve (14), which is thus preventing the pump piston (7) from touching or compromising the pressure sensor (10) or an inner surface (30) of the cylinder wall (4) when moving past the position of the pressure sensor (10). Also disclosed are a liquid handling robot that comprises a single or multiple arrangement of the positive displacement pump (1) and liquid handling workstation that comprises such a liquid handling robot.

21 Claims, 3 Drawing Sheets

FOREIGN PATENT DOCUMENTS

Figures 1A, 1B:
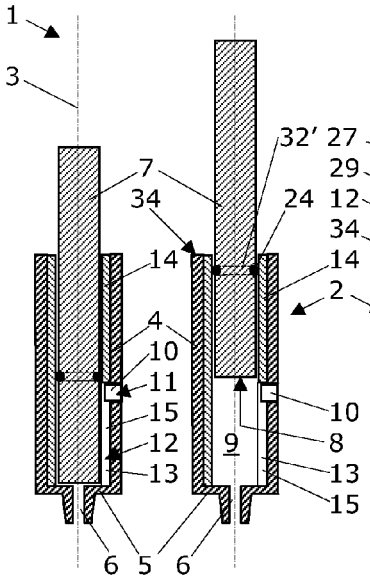

| | | |
|---|---|---|
| EP | 0316763 | 5/1989 |
| EP | 0569213 | 11/1993 |
| EP | 0571100 | 11/1993 |
| EP | 1319437 | 6/2003 |
| EP | 1557675 | 1/2004 |
| EP | 1477815 | 5/2004 |
| EP | 1531004 | 5/2005 |
| EP | 1614468 | 1/2006 |
| EP | 1652583 | 5/2006 |
| EP | 1752775 | 2/2007 |
| EP | 1882951 | 1/2008 |
| EP | 1949875 | 7/2008 |
| EP | 2006020 | 12/2008 |
| JP | 2006098336 | 4/2006 |
| JP | 2007292630 | 11/2007 |
| WO | WO2007024193 | 3/2007 |
| WO | WO2010060448 | 6/2010 |

* cited by examiner

POSITIVE DISPLACEMENT PUMP WITH PRESSURE SENSOR

CROSS REFERENCE TO RELATED APPLICATIONS

This patent application is a continuation of U.S. patent application Ser. No. 12/692,089 of Jan. 22, 2010, the entire disclosure of which is incorporated herein by reference for all purposes.

FIELD OF TECHNOLOGY

The present invention relates to a positive displacement pump comprising a pump cylinder and a pump piston. The pump cylinder comprises a longitudinal axis, a cylinder wall extending parallel to the longitudinal axis, a cylinder bottom extending essentially perpendicular to the longitudinal axis, and a cylinder outlet that is located in or close to the cylinder bottom. The pump piston comprises a piston front that is reciprocally movable inside the pump cylinder in direction of the longitudinal axis. The positive displacement pump also comprises a cylinder space that is located inside the pump cylinder and that is defined by the cylinder wall, the cylinder bottom, and the piston front and a pressure sensor that is located in or outside of an orifice in the cylinder wall for detecting the pressure in the cylinder space. The positive displacement pump further comprises a pressure channel, a main portion thereof extending parallel to the longitudinal axis of the pump cylinder, for providing fluidic connection between the cylinder space and the pressure sensor. Such positive displacement pumps are preferably used for aspiration into and/or dispensation of liquids from a pipette or dispenser tip that is in fluidic working connection with the cylinder outlet of the positive displacement pump. Positive displacement pumps e.g. comprise piston pumps, plunger pumps and syringe pumps. Single and multiple arrangements of such positive displacement pumps and their associated pipette or dispenser tips are contemplated for implementation into a liquid handling device or liquid handling robot. Such liquid handling tools are known from e.g. automated pipetters or dispensers that are accomplished to take up and/or deposit liquid samples and that are a preferred part of liquid handling workstations or robotic sample processors such as the GENESIS Freedom® workstation or the Freedom EVO® platform (both of Tecan Trading AG, 8708 Männedorf, Switzerland).

RELATED PRIOR ART

From the U.S. Pat. No. 5,499,545, a pipetting device is known which's measurement accuracy is improved by eliminating the influence of changes in the atmospheric and internal pressures on the quantity of a liquid absorbed or discharged. The pipetting device is equipped with a pressure sensor that measures the pressure inside a cylinder portion of a piston pump. The pressure sensor is fluidly connected to the cylinder portion by a piper portion that is located between the cylinder and the pipette tip. A similar arrangement is known from the European patent application EP 0 215 534 A2, where a pressure gouge is fluidly connected to the tubing between the pump cylinder and the pipette tube using a T-piece.

From the European patent application EP 0 571 100 A1, a pipette apparatus which operates on the air-piston principle is known. Operation is monitored and/or controlled on the basis of the air pressure measured by a pressure sensor that is connected to the air space of the pipette. The pressure sensor is connected to a cylindrical tube of the pipette so that it measures the air pressure in the cylinder. A control unit registers pressure changes in the air space of the pipette and functions as an alarm unit in case of a malfunction or controls the operation of the pipette on the basis of the pressure changes in the air space of the pipette.

A dispenser and dispensing device is known from the U.S. Pat. No. 7,314,598 B2. The dispenser has a pressure sensor enabled to detect a pressure precisely by forming a pressure sensor integrally with a syringe construction a nozzle to thereby eliminate a pipeline or the like (as e.g. used in all earlier addressed prior art documents). The dispenser is provided for sucking and discharging a liquid from a nozzle by slidably moving a piston sliding inside of a syringe by a motor mounted in a body. A detection sensor for detecting the internal pressure of the inside of the syringe is integrally formed by connecting its air inlet directly to a through hole formed to extend to the inner surface of the syringe. However, there is some dead-volume left at the cylinder outlet, the pressure of which dead-volume cannot be measured by the proposed setup.

OBJECTS AND SUMMARY OF THE PRESENT INVENTION

One object of the present invention is the provision of an alternative positive displacement pump arrangement with a pressure sensor for use in a pipetting or dispensing devices; the alternative positive displacement pump arrangement at least partially eliminating drawbacks known from the prior art.

A first object is achieved with an improved positive displacement pump as introduced at the beginning of the specification, the positive displacement pump comprising a pressure channel, a main portion thereof extending parallel to the longitudinal axis of the pump cylinder, for providing fluidic connection between the cylinder space and the pressure sensor. The improvement according to the present invention is based on the features that the cylinder wall comprises a piston sleeve, the piston sleeve being located on the inner side of the cylinder wall and extending over essentially the entire length of the pump cylinder to the cylinder bottom, and that the main portion of the pressure channel is located in the cylinder wall comprising the piston sleeve, the piston sleeve thus preventing the pump piston from touching or compromising the pressure sensor or an inner surface of the cylinder wall when moving past the position of the pressure sensor. Additional aspects and inventive elements derive from the dependent claims.

The positive displacement pump arrangement according to the present invention at least provides for the following advantages:

- The dead-volume of the pump, i.e. the volume in which the pressure differs according to the movement of the pump piston, can be reduced to a minimum without risking damage of the pressure sensor by the movements of the pump piston.
- The volume of the pressure channel can be minimized despite placing the pressure sensor in the middle or even rear region of the pump cylinder.

BRIEF INTRODUCTION OF THE DRAWINGS

Figures 2A, 2B:
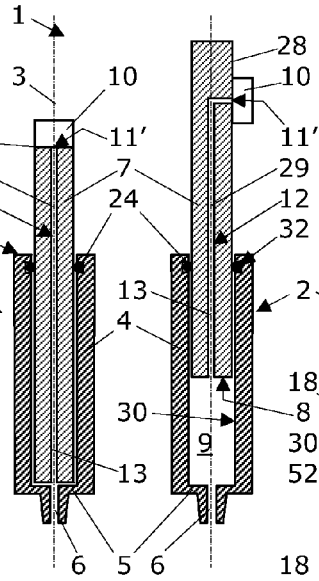
Figures 3A, 3B:
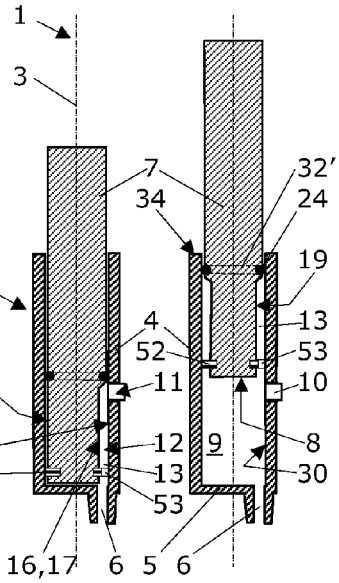
Figures 4A, 4B:
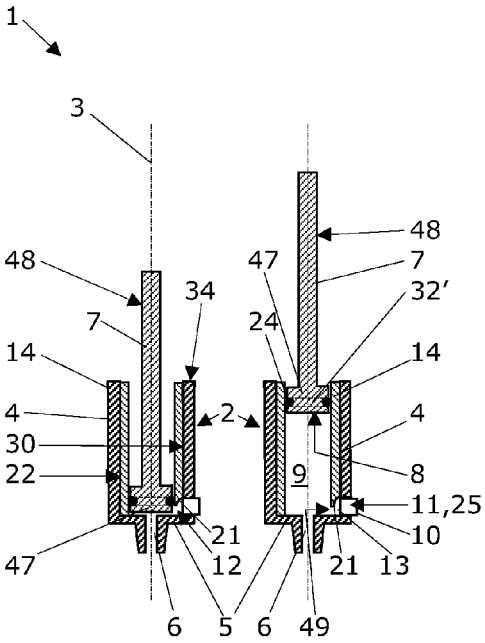
Figures 5A, 5B:
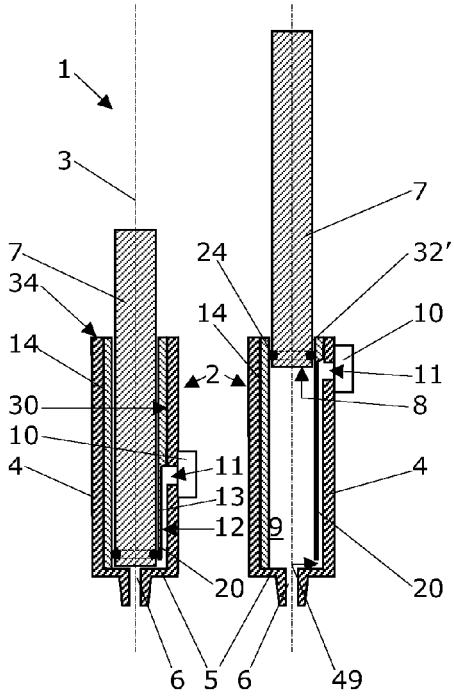
Figures 6A, 6B:
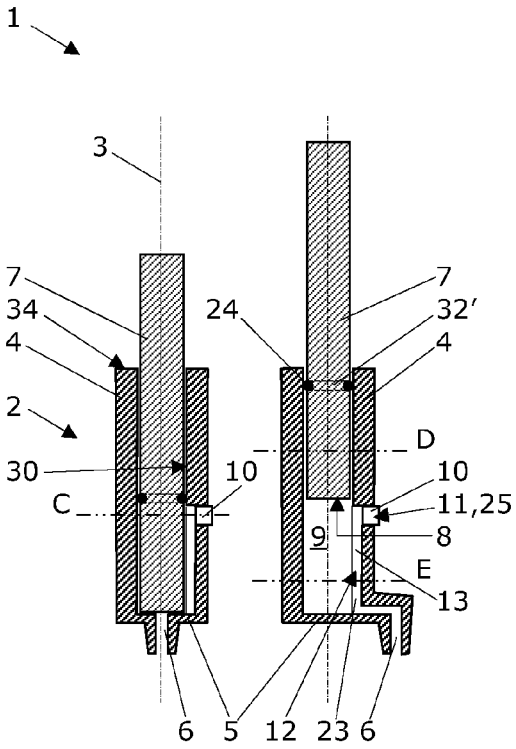
Figures 7A, 7B:
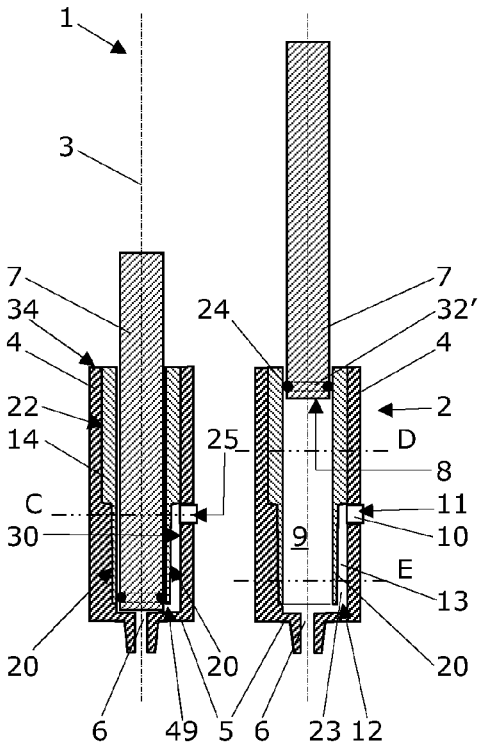
Figures 6C, 6D:
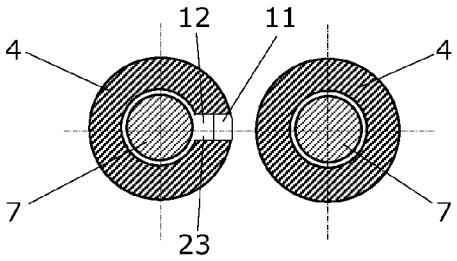
Figures 7C, 7D:
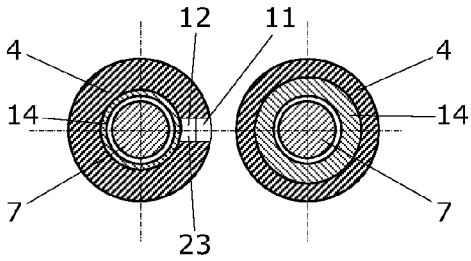
Figure 6E:
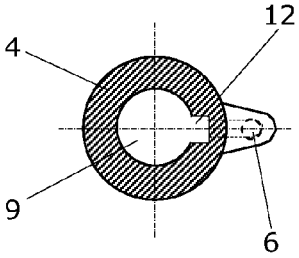
Figure 7E:
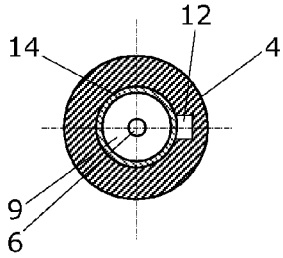
Figure 8A:
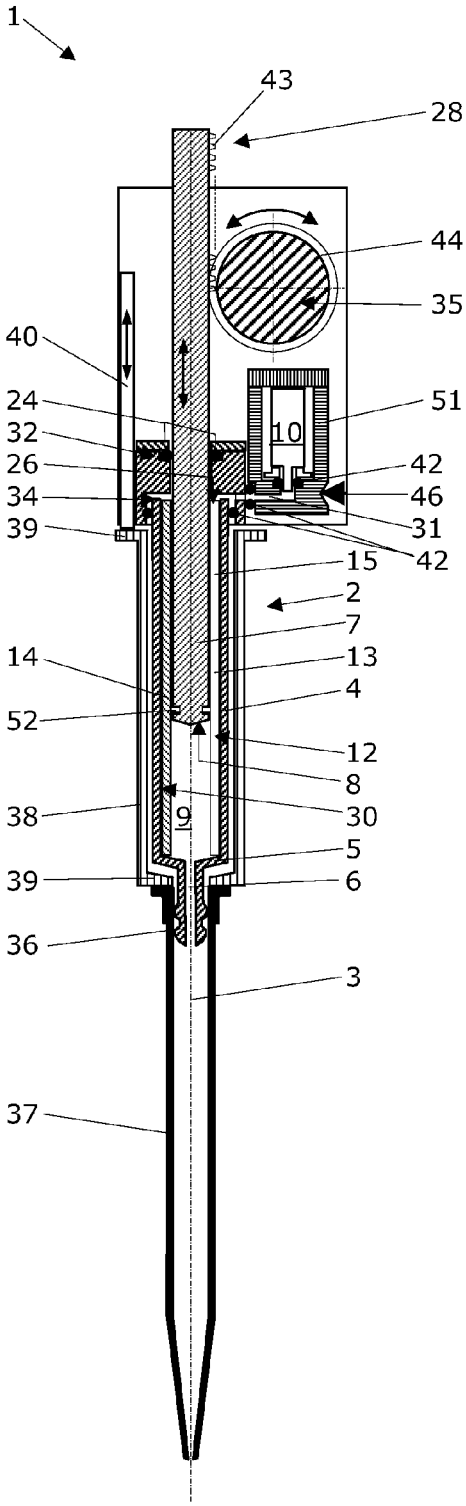
Figure 8B:
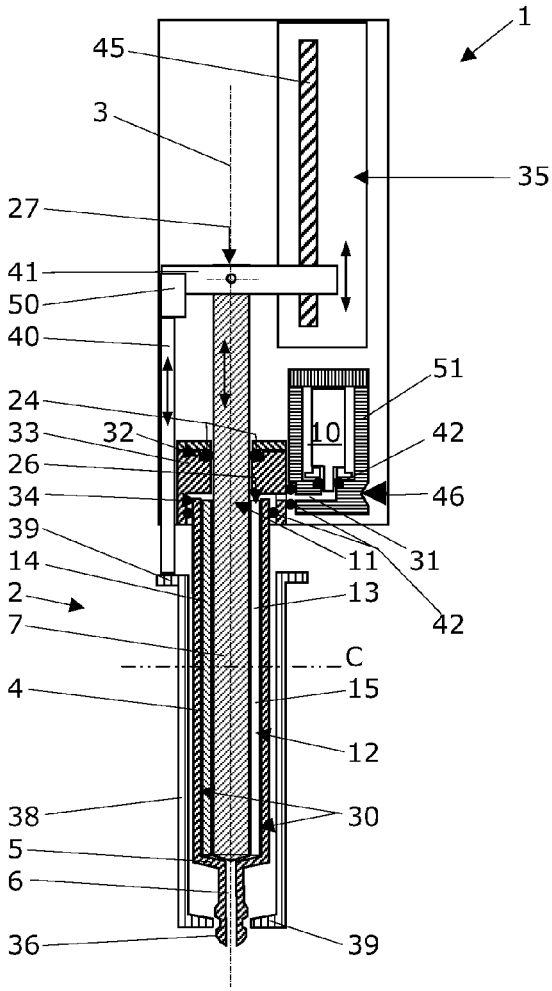
Figure 8C:
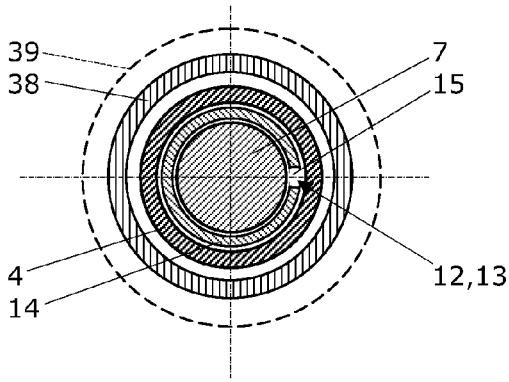

The present invention will now be described and explained with the help of the attached figures and schematic drawings, which present a non-limiting selection of preferred embodiments of the alternative positive displacement pump arrangement according to the invention. It is shown in:

FIG. 1 a positive displacement pump according to a first embodiment of the present invention, the main portion of the pressure channel being accomplished as at least one slot in a piston sleeve that is comprised by the cylinder wall; wherein FIG. 1A shows the pump piston in its foremost position, and FIG. 1B shows the pump piston in its rearmost position;

FIG. 2 a positive displacement pump according to a second embodiment of the present invention, the main portion of the pressure channel being accomplished as an inside bore of the pump piston; wherein FIG. 2A shows the pump piston in its foremost position, and FIG. 2B shows the pump piston in its rearmost position;

FIG. 3 a positive displacement pump according to a third embodiment of the present invention, the main portion of the pressure channel being accomplished as a flattening or groove in a side, or a reduction around the side of the pump piston; wherein FIG. 3A shows the pump piston in its foremost position, and FIG. 3B shows the pump piston in its rearmost position;

FIG. 4 a positive displacement pump according to a fourth embodiment of the present invention, the main portion of the pressure channel being accomplished as an extremely short undercut or a tapper on an outer side of the piston sleeve; wherein FIG. 4A shows the pump piston in its foremost position, and FIG. 4B shows the pump piston in its rearmost position;

FIG. 5 a positive displacement pump according to a fifth embodiment of the present invention, the main portion of the pressure channel being accomplished as an elongated undercut or a tapper on an outer side of the piston sleeve; wherein FIG. 5A shows the pump piston in its foremost position, and FIG. 5B shows the pump piston in its rearmost position;

FIG. 6 a positive displacement pump according to a sixth embodiment of the present invention, the main portion of the pressure channel being accomplished as a gorge in the cylinder wall; wherein FIG. 6A shows the pump piston in its foremost position, FIG. 6B shows the pump piston in its rearmost position, FIG. 6C shows a cross section in the level C of FIG. 6A, FIG. 6D shows a cross section in the level D of FIG. 6B, and FIG. 6E shows a cross section in the level E of FIG. 6B;

FIG. 7 a positive displacement pump according to a seventh embodiment of the present invention, the main portion of the pressure channel being accomplished as a combination of a gorge in the cylinder wall and an undercut or a tapper on an outer side of the piston sleeve; wherein FIG. 7A shows the pump piston in its foremost position, FIG. 7B shows the pump piston in its rearmost position, FIG. 7C shows a cross section in the level C of FIG. 7A, FIG. 7D shows a cross section in the level D of FIG. 7B, and FIG. 7E shows a cross section in the level E of FIG. 7B;

FIG. 8 a positive displacement pump according to an eighth embodiment of the present invention, the main portion of the pressure channel being accomplished as at least one slot in a piston sleeve extending over the entire length and ending at the open rear end of the pump cylinder; wherein FIG. 8A shows the pump piston in a retracted position and a disposable tip attached to the pump's reception cone, FIG. 8B shows the pump piston in its foremost position, the disposable tip ejected from the pump's reception cone, and FIG. 8C shows a cross section in the level C of FIG. 8B.

DETAILED DESCRIPTION OF THE PRESENT INVENTION

In the attached FIGS. 1-8, preferred embodiments of the positive displacement pump according to the invention are shown. In each case, the positive displacement pump 1 comprises a pump cylinder 2 with a longitudinal axis 3, a cylinder wall 4 extending parallel to the longitudinal axis 3, a cylinder bottom 5 extending essentially perpendicular to the longitudinal axis 3, and a cylinder outlet 6 that is located in or close to the cylinder bottom 5. The positive displacement pump 1 according to the invention also comprises a pump piston 7 with a piston front 8 that is reciprocally movable inside the pump cylinder 2 in direction of the longitudinal axis 3 and a cylinder space 9 that is located inside the pump cylinder 2 and that is defined by the cylinder wall 4, the cylinder bottom 5, and the piston front 8. The positive displacement pump 1 according to the invention further comprises a pressure sensor 10 that is located in or outside of an opening 11,11' in the cylinder wall 4 or the pump piston 7 for detecting the pressure in the cylinder space 9 and a pressure channel 12, a main portion 13 thereof extending parallel to the longitudinal axis 3 of the pump cylinder 2, for providing fluidic connection between the cylinder space 9 and the pressure sensor 10.

Exemplary embodiments with a cylinder outlet 6 that is located in the cylinder bottom 5 are depicted in the FIGS. 1-5, 7 and 8. The cylinder outlet 6 can be located in the center of the cylinder bottom 5 (see FIGS. 1, 2, 4, 5, 6A, 7, and 8) with the cylinder outlet 6 extending along the longitudinal axis 3. The cylinder outlet 6 can be located off-center in the cylinder bottom 5 (see FIGS. 3 and 6B). The cylinder outlet 6 in FIG. 6B is located close to the cylinder bottom 5, first starting essentially perpendicular to the longitudinal axis 3 (as an opening in the cylinder wall 4) and then ending essentially parallel to the longitudinal axis 3. The pressure sensor 10, when located in an opening 11 in the cylinder wall 4, preferably is positioned such that its pressure transducer front is flush with the inner surface 30 of the cylinder wall 4 (see e.g. FIGS. 3 and 4). The pressure sensor 10, when located outside of an opening 11 in the cylinder wall 4, preferably is positioned directly to the outer surface of the cylinder wall 4 (see e.g. FIG. 5) or in fluidic communication with the main portion 13 of the pressure channel 12 via a transverse channel 31 (see e.g. FIG. 8). The pressure sensor 10, when located outside of an opening 11' in the pump piston 7, preferably is located at the rear end 27 of the pump piston 7 (see. e.g. FIG. 2A). A pressure sensor 10 measures pressure of fluids, typically of gases, liquids or gas/liquid mixtures. Pressure is an expression of the force required to stop a fluid from expanding, and is usually stated in terms of force per unit area.

A pressure sensor usually acts as a transducer, it generates a signal as a function of the pressure imposed. For the purposes of this patent application, such a signal is electrical. The pressure transducer may be selected from a group including a piezoresistive strain gage and pressure transducers working on the base of capacitive, electromagnetic, piezoelectric or optical principles. Particularly preferred is a pressure sensor of the type Honeywell 26PC01SMT (Honeywell Sensing and Control, Golden Valley, Minn. 55422), featuring Wheatstone bridge construction, silicon piezoresistive technology, and ratiometric output.

In the positive displacement pump 1 according to the invention, the main portion 13 of the pressure channel 12 is located inside of the pump cylinder 2 or pump piston 7, extending, at least in a foremost position of the pump piston 7, from the cylinder bottom 5 beyond or to the opening 11,11' in the cylinder wall 4 or pump piston 7.

The main portion 13 of the pressure channel 12, when located inside of the pump cylinder 2, may be accomplished in a variety of embodiments, some of them are depicted in the FIGS. 1, and 2-8. The main portion 13 of the pressure channel 12, when located inside of the pump piston 7, may e.g. be accomplished according to the FIG. 2. In any case, the main portion 13 of the pressure channel 12 extends from the cylinder bottom 5 beyond or to the opening 11 (in the cylinder wall 4) or 11' (in the pump piston 7) respectively. In a case where the pressure channel 12 extends from the cylinder bottom 5 to the opening 11' in the pump piston 7, the main portion 13 of the pressure channel 12 preferably starts at the piston front 8 (see FIG. 2).

The different embodiments are now described in more detail with the help of the attached drawings.

FIG. 1 shows a positive displacement pump 1 according to a first embodiment of the present invention. The main portion 13 of the pressure channel 12 preferably is accomplished as a single slot 15 in a piston sleeve 14 that is comprised by the cylinder wall 4. A sealing member 24, preferably in the form of an O-ring or lip seal, is located between the pump piston 7 and the piston sleeve 14. The sealing member 24 is accomplished as a moving seal that is captured in a recess 32' of the pump piston 7 and that is accommodated to slidingly move over the surface of the piston sleeve 14.

FIG. 1A shows the pump piston 7 in its foremost position, touching with its piston front 8 the cylinder bottom 5. The opening 11 in the cylinder wall 4 and the sealing member 24 of the pump piston 7 are positioned such that the pressure sensor 10 is at the rear border of, but inside the cylinder space 9. The sensor 10 here slightly protrudes into the main portion 13 of the pressure channel 12 that is provided by at least one slot 15 in the piston sleeve 14.

FIG. 1B shows the pump piston 7 in its rearmost position, reaching with its sealing member 24 almost the rear end 34 of the pump cylinder 2.

From the embodiment of FIG. 1 it is clear that the opening 11 in the cylinder wall 4 has to be in the lower half of the pump cylinder 2, thus restricting the delivery volume of the positive displacement pump 1 to about half of the volume of the pump cylinder 2. The pump cylinder 2 preferably is produced from stainless steel (advantageously if electrical conductivity for liquid level detection is desired) or from a polymer material, such as polypropylene. The pump piston 7 and the piston sleeve 14 preferably are produced from stainless steel. The sealing member 24 preferably is of an inert rubber such as Neoprene.

FIG. 2 shows a positive displacement pump 1 according to a second embodiment of the present invention. The main portion 13 of the pressure channel 12 is accomplished as an inside bore 29 of the pump piston 7, reaching from the piston front 8 to the opening 11' at a rear end 27 or on a rear side 28 of the pump piston 7. A sealing member 24, preferably in the form of an O-ring or lip seal, is located between the pump piston 7 and the cylinder wall 4. The sealing member 24 is accomplished as a stationary seal that is captured in a recess 32 of the cylinder wall 4 and that is accommodated to slidingly touch the surface of the moving pump piston 7.

FIG. 2A shows the pump piston 7 in its foremost position, touching with its piston front 8 the cylinder bottom 5. The opening 11' in the pump piston 7 (situated at a rear end 27 of the pump piston 7) and the sealing member 24 of the pump piston 7 are positioned independently from each other and the pressure sensor 10 is not attached to the pump cylinder 2 but to the pump piston 7. The pressure sensor 10 here is located completely outside of the pump cylinder 2.

FIG. 2B shows the pump piston 7 about half way towards its rearmost position, in which the piston front is close to the stationary sealing member 24 that is positioned almost at the rear end 34 of the pump cylinder 2. The opening 11' in the pump piston 7 (situated on a rear side 28 of the pump piston 7) and the sealing member 24 of the pump piston 7 are positioned independently from each other and the pressure sensor 10 is not attached to the pump cylinder 2 but to the pump piston 7. Also here, the pressure sensor 10 here is located completely outside of the pump cylinder 2.

From the embodiment of FIG. 2 it is clear that the pump cylinder 2 has about double the delivery volume if compared with the embodiment of FIG. 1. The variant according to FIG. 2A is preferred over the variant of FIG. 2B, because it allows shortening the pump piston 7 without changing the delivery volume. The pump cylinder 2 preferably is produced from stainless steel (advantageously if electrical conductivity for liquid level detection is desired) or from a polymer material, such as polypropylene. The pump piston 7 preferably is produced from an inert polymer material that advantageously provides electric insulation for the pressure sensor with respect to the pump cylinder 2. The sealing member 24 preferably is of an inert rubber such as Neoprene. The pressure sensor 10 can be located at the rear end 27 of the pump piston 7 (see FIG. 2A) or at the rear side 28 of the pump piston 7 (see FIG. 2B) according to the requirements of a liquid handling robot or liquid handling system (both not shown), the positive displacement pump 1 is attached to or incorporated in.

FIG. 3 shows a positive displacement pump 1 according to a third embodiment of the present invention. The main portion 13 of the pressure channel 12 is accomplished as a flattening 16 or groove 17 in a side 18, or as a reduction 19 around the side 18 of the pump piston 7. A sealing member 24, preferably in the form of an O-ring or lip seal, is located between the pump piston 7 and the cylinder wall 4. The sealing member 24 is accomplished as a moving seal that is captured in a recess 32' of the pump piston 7 and that is accommodated to slidingly move over the surface of the cylinder wall 4.

FIG. 3A shows the pump piston 7 in its foremost position, touching with its piston front 8 the cylinder bottom 5. The opening 11 in the cylinder wall 4 and the sealing member 24 of the pump piston 7 are positioned such that the sealing member 24 does not mover over the pressure sensor 10, which thus always is located inside the cylinder space 9. The main portion 13 of the pressure channel 12 is accomplished as a flattening 16 or groove 17 in a side 18 of the pump piston 7. The provision of two or more grooves 17 in a side of the pump piston is included in the present invention. The sensor 10 here is flush with the inner surface 30 of the cylinder wall 4. The cylinder outlet 6 is arranged eccentric or off-center with respect to the longitudinal axis 3 of the positive displacement pump 1.

FIG. 3B shows the pump piston 7 in its rearmost position, reaching with its sealing member 24 almost the rear end 34 of the pump cylinder 2. The main portion 13 of the pressure channel 12 is accomplished as a reduction 19 around the side 18 of the pump piston 7.

From the embodiment of FIG. 3 it is clear that the opening 11 in the cylinder wall 4 has to be in the lower half of the pump cylinder 2, thus restricting the delivery volume of the positive displacement pump 1 to about half of the volume of the pump cylinder 2. The pump cylinder 2 preferably is produced from stainless steel (advantageously if electrical conductivity for liquid level detection is desired), from a polymer material, such as polypropylene, or a combination thereof. The pump piston 7 preferably is produced from stainless steel. The sealing member 24 preferably is of an inert rubber such as Neoprene. Preferably, the main portion 13 of the pressure channel 12 and the cylinder outlet 6 are in a linear arrangement (as depicted), enabling the pressure sensor 10 to permanently detect the pressure in the pump cylinder 2, in the cylinder outlet 6 (as well as in a pipette or dispenser tip 37 attached to the cylinder outlet 6) independent from the actual position of the pump piston 7. Such arrangement enables e.g. clot detection during aspiration of a sample liquid. Whereas a one-sided flattening 16 or a reduction 19 are preferred for ease of manufacturing and orientation with respect to the pressure sensor 10, a one-sided groove 17 is preferred for minimizing the volume of the main portion 13 of the pressure channel 12 and thus the dead-volume of the positive displacement pump 1. For guiding the pump piston 7 inside of the pump cylinder 2, a guide bushing 52 may be provided. This guide bushing 52 preferably is applied around the pump piston 7 and close to the piston front 8. In order to not interrupt the pressure channel 12 and to let the air go through, the guide bushing 52 preferably comprises a hole or cutout 53 that preferably is facing the opening 11 and thus the pressure sensor 10. In consequence, moving the pump piston 7 (and the guide bushing 52 that travels with the piston) to its rearmost position will not compromise the sensor 10, even when the guide bushing 52 is moved past the sensor 10. Departing from the embodiment as depicted in the FIGS. 3A and 3B (where the only guide bushing 52 is located in front of the sealing member 24), but not departing from the spirit of the present invention, the guide bushing 52 can also be located in front and behind, or only behind the sealing member 24. It is preferred however that in these cases, the rear guide bushing 52 is applied to the pump piston 7 at a location that does not leave the pump cylinder 2, even when the pump piston is moved to its rearmost position.

FIG. 4 shows a positive displacement pump 1 according to a fourth embodiment of the present invention. The main portion 13 of the pressure channel 12 is accomplished as a tapper 21 on an outer side 22 of the piston sleeve 14. A sealing member 24, preferably in the form of an O-ring or lip seal, is located between the pump piston 7 and the piston sleeve 14. The sealing member 24 is accomplished as a moving seal that is captured in a recess 32' of the pump piston 7 and that is accommodated to slidingly move over the surface of the piston sleeve 14. The pump piston 7 here comprises a front plate 47 with the piston front 8 and the recess 32' with the sealing member 24. The pump piston 7 also comprises a piston rod 48 that is engaged by a piston drive. Such a piston drive (preferably a motor drive 35, see FIG. 8) is preferred for all embodiments of the present invention in order to equip an automated liquid handling robot or liquid handling workstation with one or a plurality of positive displacement pumps 1 according to the invention.

FIG. 4A shows the pump piston 7 in its foremost position, touching with its piston front 8 the cylinder bottom 5. The opening 11 in the cylinder wall 4 and thus the pressure sensor 10 are located close to the cylinder bottom 5. The sealing member 24 of the pump piston 7 is positioned such that it sealingly touches the piston sleeve 14, which leaves open an entrance slit 49 between the lower end of the tapper 21 on the outer side 22 of the piston sleeve 14 and the cylinder bottom 5. This entrance slit 49 ensures fluidic connection of the main portion 13 of the pressure channel 12 with the cylinder space 9. The sensor 10 here is flush with the inner surface 30 of the cylinder wall 4.

FIG. 4B shows the pump piston 7 in its rearmost position, reaching with its sealing member 24 almost the rear end 34 of the pump cylinder 2.

From the embodiment of FIG. 4 it is clear that the position of the opening 11 in the cylinder wall 4 has no influence on the delivery volume of the positive displacement pump 1. The pump cylinder 2 preferably is produced from stainless steel (advantageously if electrical conductivity for liquid level detection is desired) or from a polymer material, such as polypropylene. The pump piston 7 and the piston sleeve 14 preferably are produced from stainless steel. The sealing member 24 preferably is of an inert rubber such as Neoprene.

FIG. 5 shows a positive displacement pump 1 according to a fifth embodiment of the present invention that is in many respects similar to the fourth embodiment. The main portion 13 of the pressure channel 12 is accomplished as an undercut 20 on an outer side 22 of the piston sleeve 14. A sealing member 24, preferably in the form of an O-ring or lip seal, is located between the pump piston 7 and the piston sleeve 14. The sealing member 24 is accomplished as a moving seal that is captured in a recess 32' of the pump piston 7 and that is accommodated to slidingly move over the surface of the piston sleeve 14.

FIG. 5A shows the pump piston 7 in its foremost position, touching with its piston front 8 the cylinder bottom 5. The opening 11 in the cylinder wall 4 and thus the pressure sensor 10 are located about in the middle of the pump cylinder 2. The sealing member 24 of the pump piston 7 is positioned such that it sealingly touches the piston sleeve 14, which leaves open an entrance slit 49 between the lower end of the undercut 20 on the outer side 22 of the piston sleeve 14 and the cylinder bottom 5. This entrance slit 49 ensures fluidic connection of the main portion 13 of the pressure channel 12 with the cylinder space 9. The sensor 10 here is located outside of the cylinder wall 4. Deviating from FIG. 5, but not from the present invention, the front of the pressure transducer may at last partially reach into the opening 11 in the cylinder wall 4 (not shown).

FIG. 5B shows the pump piston 7 in its rearmost position, reaching with its sealing member 24 almost the rear end 34 of the pump cylinder 2.

From the embodiment of FIG. 5 it is clear that the position of the opening 11 in the cylinder wall 4 has no influence on the delivery volume of the positive displacement pump 1. Moreover (and distinguishing this fifth embodiment from the embodiment of FIG. 4), the location of the opening 11 in the cylinder wall 4 and thus the location of the pressure sensor 10 can arbitrarily be chosen along almost the whole length of the pump cylinder 2 and according to the requirements of a liquid handling robot or liquid handling system (both not shown) the positive displacement pump 1 is attached to or incorporated in. The pump cylinder 2 preferably is produced from stainless steel (advantageously if electrical conductivity for liquid level detection is desired) or from a polymer material, such as polypropylene. The pump piston 7 and the piston sleeve 14 preferably are produced from stainless steel. The sealing member 24 preferably is of an inert rubber such as Neoprene.

FIG. 6 shows a positive displacement pump 1 according to a sixth embodiment of the present invention. As in the previous FIGS. 1 and 3-5, the opening 11 in the cylinder wall 4 is accomplished as a through hole 25 in the cylinder wall 4. The main portion 13 of the pressure channel 12 is accomplished as a gorge 23 in the cylinder wall 4. A sealing member 24, preferably in the form of an O-ring or lip seal, is located between the pump piston 7 and the cylinder wall 4. The sealing member 24 is accomplished as a moving seal that is captured in a recess 32' of the pump piston 7 and that is accommodated to slidingly move over the surface of the cylinder wall 4.

FIG. 6A shows the pump piston 7 in its foremost position, touching with its piston front 8 the cylinder bottom 5. The opening 11 in the cylinder wall 4 and the sealing member 24 of the pump piston 7 are positioned such that the sealing member 24 does not mover over the pressure sensor 10, which thus always is located inside the cylinder space 9. The sensor 10 here is recessed with respect to the inner surface 30 of the cylinder wall 4. The cylinder outlet 6 is arranged concentric with respect to the longitudinal axis 3 of the positive displacement pump 1.

FIG. 6B shows the pump piston 7 in its rearmost position, reaching with its sealing member 24 almost the rear end 34 of the pump cylinder 2. The cylinder outlet 6 is arranged off-center with respect to the longitudinal axis 3 of the positive displacement pump 1. As noted already, the cylinder outlet 6 here is located close to the cylinder bottom 5, first starting essentially perpendicular to the longitudinal axis 3 (as an opening in the cylinder wall 4) and then ending essentially parallel to the longitudinal axis 3. It is well known to linearly arrange the pipette or dispenser tips 37 of a plurality of similar positive displacement pumps 1 with respect to a Y-axis that runs essentially horizontal and at a right angle with respect to an X-axis, the latter being the movement direction of a liquid handling robot along a liquid handling workstation. It also is common to linearly arrange a plurality of (e.g. eight or twelve) pipette or dispenser tips 37 of similar positive displacement pumps 1 on the Y-axis in a way that they can be positioned with variable but equal distance between the individual pipette or dispenser tips 37 of all positive displacement pumps 1. Thanks to the extreme offset of the cylinder outlets 6 with respect to the longitudinal axis 3 of each one of the positive displacement placement pumps 1, the smallest pitch of the pipette or dispenser tips 37 parallel arranged along a Y-axis can be minimized to only little more than the diameter of the pipette or dispenser tips 37, if the positive displacement pumps 1 are alternately arranged along the Y-axis as it is e.g. known from the European patent EP 1 477 815 B1.

From the embodiment of FIG. 6 it is clear that the opening 11 in the cylinder wall 4 has to be in the lower half of the pump cylinder 2, thus restricting the delivery volume of the positive displacement pump 1 to about half of the volume of the pump cylinder 2. The pump cylinder 2 preferably is produced from stainless steel (advantageously if electrical conductivity for liquid level detection is desired), from a polymer material, such as polypropylene, or a combination thereof. The pump piston 7 preferably is produced from stainless steel. The sealing member 24 preferably is of an inert rubber such as Neoprene. Preferably, the main portion 13 of the pressure channel 12 and the cylinder outlet 6 are in a linear arrangement (as depicted), enabling the pressure sensor 10 to permanently detect the pressure in the pump cylinder 2, in the cylinder outlet 6 (as well as in a pipette or dispenser tip 37 attached to the cylinder outlet 6) independent from the actual position of the pump piston 7. Such arrangement enables e.g. clot detection during aspiration of a sample liquid.

FIG. 7 shows a positive displacement pump 1 according to a seventh embodiment of the present invention that is in many respects similar to the fifth embodiment. Also here, the main portion 13 of the pressure channel 12 is accomplished as an undercut 20 on an outer side 22 of the piston sleeve 14. A sealing member 24, preferably in the form of an O-ring or lip seal, is located between the pump piston 7 and the piston sleeve 14. The sealing member 24 is accomplished as a moving seal that is captured in a recess 32' of the pump piston 7 and that is accommodated to slidingly move over the surface of the piston sleeve 14. The opening 11 in the cylinder wall 4 and thus the pressure sensor 10 are located about in the middle of the pump cylinder 2. The sealing member 24 of the pump piston 7 is positioned such that it sealingly touches the piston sleeve 14, which leaves open an entrance slit 49 between the lower end of the undercut 20 on the outer side 22 of the piston sleeve 14 and the cylinder bottom 5. This entrance slit 49 ensures fluidic connection of the main portion 13 of the pressure channel 12 with the cylinder space 9. The sensor 10 here is located in a through hole 25 the cylinder wall 4, the sensor being recessed with respect to the inner surface 30 of the cylinder wall 4. Preferably the pump cylinder 2 is molded from an inert polymer with left open space that is needed for the accommodation of the piston sleeve 14 and the gorge 4. The piston sleeve 14 and pump piston 7 preferably are manufactured from stainless steel. The sealing member 24 preferably is of an inert rubber such as Neoprene.

FIG. 7A shows the pump piston 7 in its foremost position, practically touching with its piston front 8 the cylinder bottom 5.

FIG. 7B shows the pump piston 7 in its rearmost position, reaching with its sealing member 24 almost the rear end 34 of the pump cylinder 2.

From the embodiment of FIG. 7 it is clear that the position of the opening 11 in the cylinder wall 4 has no influence on the delivery volume of the positive displacement pump 1. Moreover (and similar to the fifth embodiment of FIG. 5), the location of the opening 11 in the cylinder wall 4 and thus the location of the pressure sensor 10 can arbitrarily be chosen along almost the whole length of the pump cylinder 2 and according to the requirements of a liquid handling robot or liquid handling system (both not shown) the positive displacement pump 1 is attached to or incorporated in.

FIG. 8 shows a positive displacement pump 1 according to an eighth embodiment of the present invention. The opening 11 in the cylinder wall 4 is accomplished as a rear opening 26 at an end 34 of the pump cylinder 2 that is opposite to the cylinder bottom 5. The main portion 13 of the pressure channel 12 is accomplished as at least one slot 15 in a piston sleeve 14 that is comprised by the cylinder wall 4. The piston sleeve 14 extends over essentially the entire length of the pump cylinder 2 and the at least one slot 15 in the piston sleeve 14 extends over essentially the entire length of the piston sleeve 14. The pressure sensor 10 is located outside the opening 11 (the rear opening 26 in this case) of the cylinder wall 4 and a transverse channel 31 fluidly connects the pressure sensor 10 with the pressure channel 12. A sealing member 24, preferably in the form of an O-ring or lip seal, is accomplished as a stationary seal that is captured in a recess 32 of a cylindrical part 33 located at the rear end 34 of the pump cylinder 2. The sealing member 24 is accommodated to be slidingly and sealingly contacted by the surface of the moving piston sleeve 14. A motor drive 35 preferably is located close to the pump piston 7 for reciprocally driving the pump piston 7 in direction of the longitudinal axis 3. A reception cone 36 for receiving a disposable pipette or dispenser tip 37 is located at and coaxial with the cylinder outlet. The positive displacement pump 1 according to the eighth embodiment in addition comprises an ejection tube 38 for ejecting a disposable pipette or dispenser tip 37 from the reception cone 36. This ejection tube 38 is coaxially arranged with and positioned on the outer side of the pump cylinder 2. At or close to its top, the ejection tube 38 comprises an outwards protruding flange 39 for abutment with an ejection actuator 40. At its base, the ejection tube 38 comprises an inwards protruding flange 39 for abutment with the rear rim of a disposable pipette or dispenser tip 37. At all necessary places, O-rings 42 are preferred to seal the pump cylinder 2 against the environment. A casing 51 preferably encloses the sensor 10 and is sealingly pressed against the cylindrical part 33 using a forcing screw 46 (exemplified in the FIG. 8 as a black triangle).

FIG. 8A shows the pump piston 7 in a retracted position and a disposable tip 37 attached to the pump's reception cone 36. The motor drive 35 in a first version is equipped with a gear wheel 44 driving the pump piston 7 which is equipped on its rear side 28 with a gear rack 43. However, any other appropriate drive could be used for reciprocally moving the pump piston 7 in the pump cylinder 2. Preferably another or the same motorized drive is used for actuating the ejection actuator 40, which preferably is equipped with a retaining spring (not shown). For guiding the pump piston 7 inside of the pump cylinder 2, a guide bushing 52 may be provided. This guide bushing 52 preferably is applied around the pump piston 7 and close to the piston front 8. Here, the guide bushing 52 (that travels with the piston) cannot touch or otherwise compromise the sensor 10 when moving past the position of the sensor 10, because of the at least one slot 15 in the piston sleeve 14. In consequence, this guide bushing 52 does not need a hole or cutout 53. For minimizing dead volume, and thus increasing accuracy of the positive displacement pump 1, a single slot 15 is preferred.

FIG. 8B shows the pump piston 7 in its foremost position, practically touching with its piston front 8 the cylinder bottom 5. Deviating from the FIGS. 1-7, the piston front 8 in this embodiment is not plane but formed as a flat cone. Deviating from all presented embodiments, the piston front 8 may show a dome shape (not shown). The ejection tube 38 is pushed by the ejection actuator 40 to its lowermost position by which a previously mounted disposable pipette or dispenser tip 37 has been ejected. The motor drive 35 in a second version is equipped with a threaded rod 45 and a movement transmitter 41 for driving the pump piston 7 by attachment to its rear side 28. Preferably, the ejection actuator 40 is accomplished to be actuated by the motor drive 35 for reciprocally driving the pump piston 7 in direction of the longitudinal axis 3 via a movement transmitter 41 to eject the disposable pipette or dispenser tip 37 from the reception cone 36 simultaneously with a very last increment of a dispensed sample volume. In order to assist tip ejection and to amplify the movement of the ejection actuator 40, a rocker arm lever 50 is placed in working connection between the movement transmitter 41 and the ejection actuator 40. However, any other appropriate drive could be used for reciprocally moving the pump piston 7 in the pump cylinder 2. Preferably another or the same motorized drive is used for actuating the ejection actuator 40, which preferably is equipped with a retaining spring (not shown).

From the embodiment of FIG. 8 it is clear that the position of the sealing member 24 is such that it seals the pump cylinder 2 at a level that is more distal with respect to the cylinder bottom 5 than the rear end 34 of the pump cylinder 2; this position is enabled by the cylindrical part 33. Especially according to the second variant, in which no gear rack 43 is necessary for driving the pump piston 7, the maximum delivery volume of the positive displacement pump 1 is about equal to the volume of the pump cylinder 2. The pump cylinder 2 preferably is produced from stainless steel (advantageously if electrical conductivity for liquid level detection is desired) or from a polymer material, such as polypropylene. The pump piston 7 preferably is produced from stainless steel and the piston sleeve 14 preferably is produced from Teflon® (DuPont, Wilmington, USA). The sealing member 24 preferably is of an inert rubber such as Neoprene.

In general, the piston sleeve 14 is regarded as a part of the cylinder wall 4, even when it is accomplished as an insert that is pushed into the pump cylinder 2 from its rear end 34 during assembling of the positive displacement pump 1. Preferably, the positive displacement pump 1 is used for compressing and/or expanding a gas that advantageously is not miscible with a sample liquid (air or nitrogen gas). The gas in turn is used to push out (dispense) or aspirate a liquid sample volume that is preferably not larger than the volume of the utilized pipette or dispenser tip 37. Thus, the positive displacement pump 1 most preferably is accomplished and utilized as an air displacement pump.

In addition to the seal member 24 in the form of e.g. O-rings, lip seals, or combinations thereof, the provision of a liquid seal or gland fluid seal (e.g. from IVEK CORP. North Springfield, Vt. 05150, USA) is envisaged too. If such a liquid seal is chosen (alone or in combination with any one of the above seal members 24) between the pump piston 7 and the cylinder wall 4 for sealing the cylinder against the environment, the positive displacement pump 1 preferably is accomplished and utilized as a liquid displacement pump.

The same reference numerals refer to the same features, even when not in all cases the reference numeral is indicated in a drawing or individually addressed in the specification. Any combination of the herein disclosed embodiments of the positive displacement pump 1 according to the present invention that is reasonable for a person skilled in the art of building positive displacement pumps is included by the present invention.

| Reference numerals: | |
|---|---|
| 1 | positive displacement pump |
| 2 | pump cylinder |
| 3 | longitudinal axis |
| 4 | cylinder wall |
| 5 | cylinder bottom |
| 6 | cylinder outlet |
| 7 | pump piston |
| 8 | piston front |
| 9 | cylinder space |
| 10 | pressure sensor |
| 11 | opening in 4 |
| 11' | opening in 7 |
| 12 | pressure channel |
| 13 | main portion of 12 |
| 14 | piston sleeve |
| 15 | slot(s) in 14 |
| 16 | flattening in a side of 7 |
| 17 | groove in a side of 7 |
| 18 | side of 7 |
| 19 | reduction |
| 20 | undercut on an outer side of 14 |
| 21 | tapper on an outer side of 14 |
| 22 | outer side of 14 |
| 23 | gorge in 4 |
| 24 | sealing member |
| 25 | through hole |
| 26 | rear opening |
| 27 | rear end of 7 |
| 28 | rear side of 7 |
| 29 | inside bore |
| 30 | inner surface of 4 |
| 31 | transverse channel |
| 32, 32' | recess |
| 33 | cylindrical part |
| 34 | rear end of 2 |
| 35 | motor drive |
| 36 | reception cone |
| 37 | disposable pipette or dispenser tip |
| 38 | ejection tube |
| 39 | flange |

-continued

| Reference numerals: | |
|---|---|
| 40 | ejection actuator |
| 41 | movement transmitter |
| 42 | O-ring |
| 43 | gear rack |
| 44 | gear wheel |
| 45 | threaded rod |
| 46 | forcing screw |
| 47 | front plate |
| 48 | piston rod |
| 49 | entrance slit |
| 50 | rocker arm lever |
| 51 | casing |
| 52 | guide bushing |
| 53 | hole, cutout in 52 |

The invention claimed is:

1. A positive displacement pump (1) comprising:

a pump cylinder (2) with a longitudinal axis (3), a cylinder wall (4) extending parallel to the longitudinal axis (3), a cylinder bottom (5) extending essentially perpendicular to the longitudinal axis (3), and a cylinder outlet (6) that is located in or close to the cylinder bottom (5);

a pump piston (7) with a piston front (8) that is reciprocally movable inside the pump cylinder (2) in direction of the longitudinal axis (3);

a cylinder space (9) that is located inside the pump cylinder (2) and that is defined by the cylinder wall (4), the cylinder bottom (5), and the piston front (8);

a pressure sensor (10) for detecting the pressure in the cylinder space (9); said pressure sensor (10) being located in or outside of an opening (11) in the cylinder wall (4), the opening being located between a foremost and an rearmost position of the piston front (8) and a pressure channel (12), for providing fluidic connection between the cylinder space (9) and the pressure sensor (10), wherein the cylinder wall (4) comprises a piston sleeve (14), the piston sleeve (14) being located on the inner side of the cylinder wall (4) and extending over essentially the entire length of the cylinder wall (4) to the cylinder bottom (5), and wherein the pressure channel (12) comprises a main portion (13), which is located in the cylinder wall (4), said main portion (13) extending parallel to the longitudinal axis (3) of the pump cylinder (2) from the cylinder bottom (5) to or beyond the opening (11) in the cylinder wall, the piston sleeve (14) thus being accomplished to present the pump piston (7) from touching or compromising the pressure sensor (10).

2. The positive displacement pump (1) of claim 1, wherein the opening (11) in the cylinder wall (4) is accomplished as a through hole (25) in the cylinder wall (4).

3. The positive displacement pump (1) of claim 1, wherein the main portion (13) of the pressure channel (12) is accomplished as at least one slot (15) in the piston sleeve (14).

4. The positive displacement pump (1) of claim 3, wherein the at least one slot (15) in the piston sleeve (14) extends over essentially the entire length of the piston sleeve (14).

5. The positive displacement pump (1) of claim 1, wherein the main portion (13) of the pressure channel (12) is accomplished as an undercut (20) or a tapper (21) on an outer side (22) of the piston sleeve (14).

6. The positive displacement pump (1) of claim 1, wherein the main portion (13) of the pressure channel (12) is accomplished as a gorge (23) in the cylinder wall (4).

7. The positive displacement pump (1) of claim 1, wherein the pump piston (7) comprises at least one guide bushing (52) that is applied around and that travels with the pump piston (7).

8. The positive displacement pump (1) of claim 1, wherein the pressure sensor (10) is located in the opening (11) and flush or recessed with respect to the inner surface (30) of the cylinder wall (4).

9. The positive displacement pump (1) of claim 1, wherein the pressure sensor (10) is located outside the opening (11) of the cylinder wall (4), a transverse channel (31) fluidly connecting the pressure sensor (10) with the pressure channel (12).

10. The positive displacement pump (1) of claim 1, wherein a sealing member (24) is located between the pump piston (7) and the cylinder wall (4) or the piston sleeve (14).

11. The positive displacement pump (1) of claim 10, wherein the sealing member (24) is accomplished as a stationary seal that is captured in a recess (32) of the cylinder wall (4), of the piston sleeve (14), or of a cylindrical part (33) located at a rear end (34) of the pump cylinder (2).

12. The positive displacement pump (1) of claim 10, wherein the sealing member (24) is accomplished as a moving seal that is captured in a recess (32') of the pump piston (7).

13. The positive displacement pump (1) of claim 1, wherein the positive displacement pump (1) comprises a motor drive (35) for reciprocally driving the pump piston (7) in direction of the longitudinal axis (3).

14. The positive displacement pump (1) of claim 1, wherein the positive displacement pump (1) comprises a reception cone (36) for receiving a disposable pipette or dispenser tip (37).

15. The positive displacement pump (1) of claim 14, wherein the positive displacement pump (1) comprises an ejection tube (38) for ejecting a disposable pipette or dispenser tip (37) from the reception cone (36).

16. The positive displacement pump (1) of claim 15, wherein the ejection tube (38) comprises a flange (39) for abutment with an ejection actuator (40).

17. The positive displacement pump (1) of claim 16, wherein the ejection actuator (40) is accomplished to be actuated by the motor drive (35) for reciprocally driving the pump piston (7) in direction of the longitudinal axis (3) via a movement transmitter (41) to eject the disposable pipette or dispenser tip (37) from the reception cone (36) simultaneously with a very last increment of a dispensed sample volume.

18. A positive displacement pump (1) of claim 1, wherein the main portion (13) of the pressure channel (12) is located in the material of the piston sleeve (14) or in the material of the cylinder wall (4).

19. A positive displacement pump (1) of claim 1, wherein the main portion (13) of the pressure channel (12) is located in the material of the piston sleeve (14) and in the material of the cylinder wall (4).

20. A liquid handling robot that is accomplished to take up and/or deposit liquid samples, wherein the liquid handling robot comprises a single or multiple arrangement of the positive displacement pump (1) of claim 1.

21. A liquid handling workstation that comprises a liquid handling robot with a multiple arrangement of the positive displacement pump (1) according to claim 20, wherein the multiple arrangement of the positive displacement pump (1) is accomplished to receive a plurality of pipette or dispenser tips (37), which are arranged on a Y-axis that runs essentially horizontal and at a right angle with respect to an X-axis, the X-axis being the movement direction of the liquid handling robot along the liquid handling workstation.

* * * * *